United States Patent [19]

Detweiler et al.

[11] Patent Number: 4,963,407

[45] Date of Patent: Oct. 16, 1990

[54] DECORATIVE ARTICLE AND METHOD OF CONSTRUCTING SAME

[76] Inventors: Charles F. Detweiler; Linda J. Detweiler, both of 2708 N. Hickory St., Sherman, Tex. 75090

[21] Appl. No.: 326,071

[22] Filed: Mar. 20, 1989

[51] Int. Cl.[5] ..... B44C 1/28

[52] U.S. Cl. ..... 428/47; 52/311; 156/63; 428/50; 428/537.1

[58] Field of Search ..... 52/311; 156/63; 428/47, 428/48, 49, 50, 542.2, 904.4, 537.1

[56] References Cited

U.S. PATENT DOCUMENTS

| | | | |
|---|---|---|---|
| 1,838,108 | 12/1931 | Rhodes | 428/80 |
| 2,835,936 | 5/1958 | Elmendorf | 428/47 |
| 4,133,152 | 1/1979 | Penrose | 428/47 X |
| 4,225,641 | 9/1980 | Yokomizo | 428/38 X |
| 4,537,001 | 8/1985 | Uppstrom | 52/311 |
| 4,546,025 | 10/1985 | Vaisman | 428/49 X |
| 4,722,158 | 2/1988 | Urdaneta | 428/38 X |

*Primary Examiner*—Henry F. Epstein

*Attorney, Agent, or Firm*—W. Kirk McCord

[57] ABSTRACT

A decorative article is assembled using a plurality of pre-cut wood pieces. The wood pieces are of three types, a square, triangle and parallelogram, and are sized relative to one another, such that a variety of different designs and patterns can be achieved. The wood pieces are assembled on a disposable sheet having a rectangular grid to effect the desired pattern. Four wood frame members are then temporarily attached to the corresponding border surfaces of a wood substrate having the same rectangular grid pattern as the disposable sheet to define a wooden frame around the grid pattern. Wood glue is applied to individual squares of the grid pattern on the wood substrate and the wood pieces are sequentially moved from the disposable sheet to the wood substrate where they are secured in their respective proper positions on the substrate by the glue. After the decorative pattern has been assembled on the substrate, the wood frame members are glued to the border surfaces thereof to provide a rectangular frame for the decorative pattern.

20 Claims, 4 Drawing Sheets

DECORATIVE ARTICLE AND METHOD OF CONSTRUCTING SAME

FIELD OF THE INVENTION

This invention relates to decorative articles and in particular to a decorative article comprised of multiple wood pieces and a method of assembling the wood pieces to construct the decorative article.

BACKGROUND OF THE INVENTION

Colorful designs and patterns are often displayed on the walls of homes and offices to enhance the decor. Such designs and patterns are typically contained within a wood or metal frame, which is attached to the wall. It is known in the art to assemble such designs and patterns using wooden pieces in much the same way that one would assemble a puzzle.

Assembly of such wooden pieces is more difficult than one would first imagine. The pieces must be cut to conform to the particular design or pattern being assembled and typically cannot be used to assemble any other design or pattern. Furthermore, the borders of the pattern must be precisely aligned, which is often beyond the skill of the average person.

OBJECTS OF THE INVENTION

It is, therefore, the principal object of the present invention to provide an improved method of assembling a plurality of wood pieces to make a decorative design or pattern.

It is another object of the invention to provide an article assembly kit whereby different types of decorative patterns and designs can be constructed using standard wood components.

It is yet another object of the invention to provide a method of constructing multiple decorative designs and patterns using standard wood components.

SUMMARY OF THE INVENTION

These and other objects are accomplished in accordance with the present invention wherein a method of constructing a decorative article is comprised of the steps of providing a substrate having a grid pattern on a major surface thereof, a plurality of construction members for being assembled to effect a predetermined decorative pattern on the substrate and a plurality of frame members for being interconnected to define a frame around the decorative pattern. The frame members are positioned on the substrate such that the frame members surround the grid pattern to define a frame therefor and are held in position on the substrate. Adhesive material is applied to a portion of the grid pattern and selected ones of the construction members are placed at respective selected positions on the portion of the grid pattern to which the adhesive material is applied. The adhesive material is allowed to bond the construction members to the substrate. The aforementioned steps of applying adhesive material to a portion of the grid pattern and placing selected ones of the construction members at respective selected positions on the portion of the grid pattern to which adhesive material is applied is iteratively repeated until the predetermined decorative pattern is effected. After the decorative pattern is completed, the frame members are removed from the substrate and adhesive material is applied to portions of the substrate surrounding the grid pattern. The frame members are then repositioned on the portions of the substrate surrounding the grid pattern and adhesive material is allowed to bond the frame members to the substrate to define a substantially permanent frame for the decorative pattern.

In one aspect of the invention the construction members are comprised of first, second and third discrete sets of construction members, which are sized relative to one another such that they can be assembled to effect a variety of decorative designs. In one embodiment the three sets of construction members are respectively comprised of a first plurality of members having a substantially parallelogram shape, a second plurality of members having a substantially isosceles right triangle shape and a third plurality of members having a substantially square shape. Each square member has a predetermined length S along each of its sides, each triangle member has a length substantially equal to S along each of its equal legs and each parallelogram member has a length substantially equal to S along each of its short legs and a length substantially equal to $\sqrt{2}\times S$ along each of its long sides. The grid pattern is comprised of a plurality of squares, each of which has a length substantially equal to S along each of its sides. In another embodiment the frame members are comprised of relatively flat, rectangular members sized to conform to the portions of the substrate surrounding the grid pattern.

In the preferred embodiment the substrate, construction members and frame members are comprised of a wood material. A sheet member is provided having a grid pattern on a major surface thereof which is substantially identical to the grid pattern on the substrate. Selected ones of the construction members are temporarily placed at respective selected positions on the grid pattern of the sheet to effect the predetermined decorative design, prior to permanently assembling the construction members on the wood substrate. The sheet is preferably comprised of a paper material and may be disposed of after use. To facilitate positioning of the wood frame members, the substrate preferably has four boundary lines interconnected to define a substantially rectangular boundary for the grid pattern. A portion of each boundary line extends beyond an adjacent boundary line to define an extension segment on the corresponding boundary line. Each of the frame members is positioned on the substrate such that an inner edge thereof is substantially aligned with a corresponding one of the boundary lines and first and second opposite ends of each frame member are substantially aligned with the corresponding extension segment and the corresponding outer edge of the substrate, respectively. The first end of each frame member is substantially in abutment with an inner edge of an adjacent frame member to define a rectangular frame.

BRIEF DESCRIPTION OF THE DRAWINGS

Further objects and advantages of the invention will be apparent from the Detailed Description and Claims when read in conjunction with the accompanying drawings wherein:

DETAILED DESCRIPTION OF THE PREFERRED EMBODIMENT

In the description which follows like parts are marked throughout the specification and drawings, respectively. The drawings are not necessarily to scale and in some instances proportions have been exaggerated in order to more clearly depict certain features of the invention.

Figure 1:
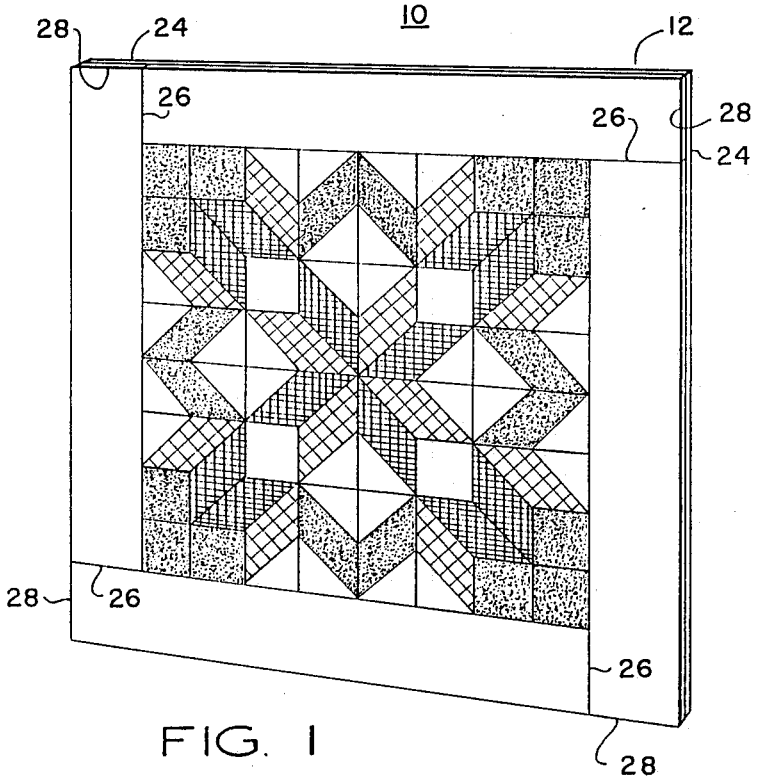
FIG. 1 is a perspective view of a decorative article assembled in accordance with the present invention.

Referring to FIG. 1, a decorative article 10 having a predetermined design or pattern in the approximate central portion thereof is depicted. The design or pattern is achieved by assembling a plurality of pre-cut wood pieces on a wood substrate to achieve the desired design or pattern, as will be described in greater detail hereinafter. The design or pattern is bounded by a rectangular wood frame 12.

Figure 2A:
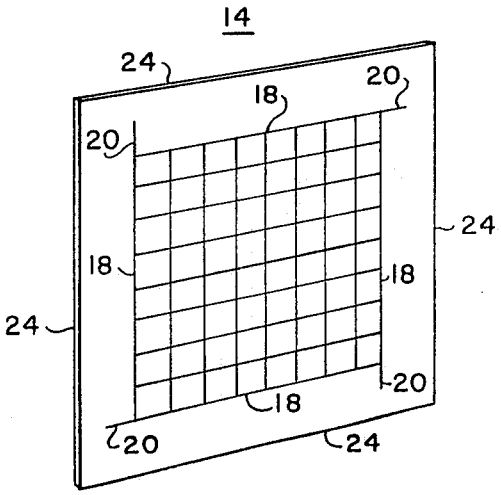
FIGS. 2A–2D are respective perspective views of wood components used to assemble the decorative article depicted in FIG. 1 in accordance with the present invention.
Figure 2B:
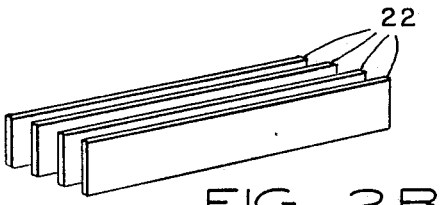
Figure 2C:
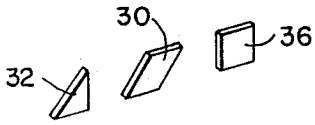
Figure 2D:
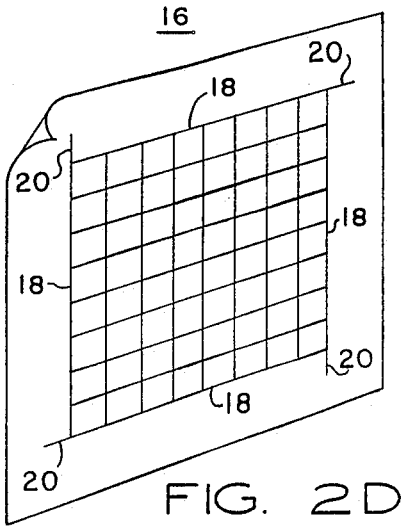
Figure 3:
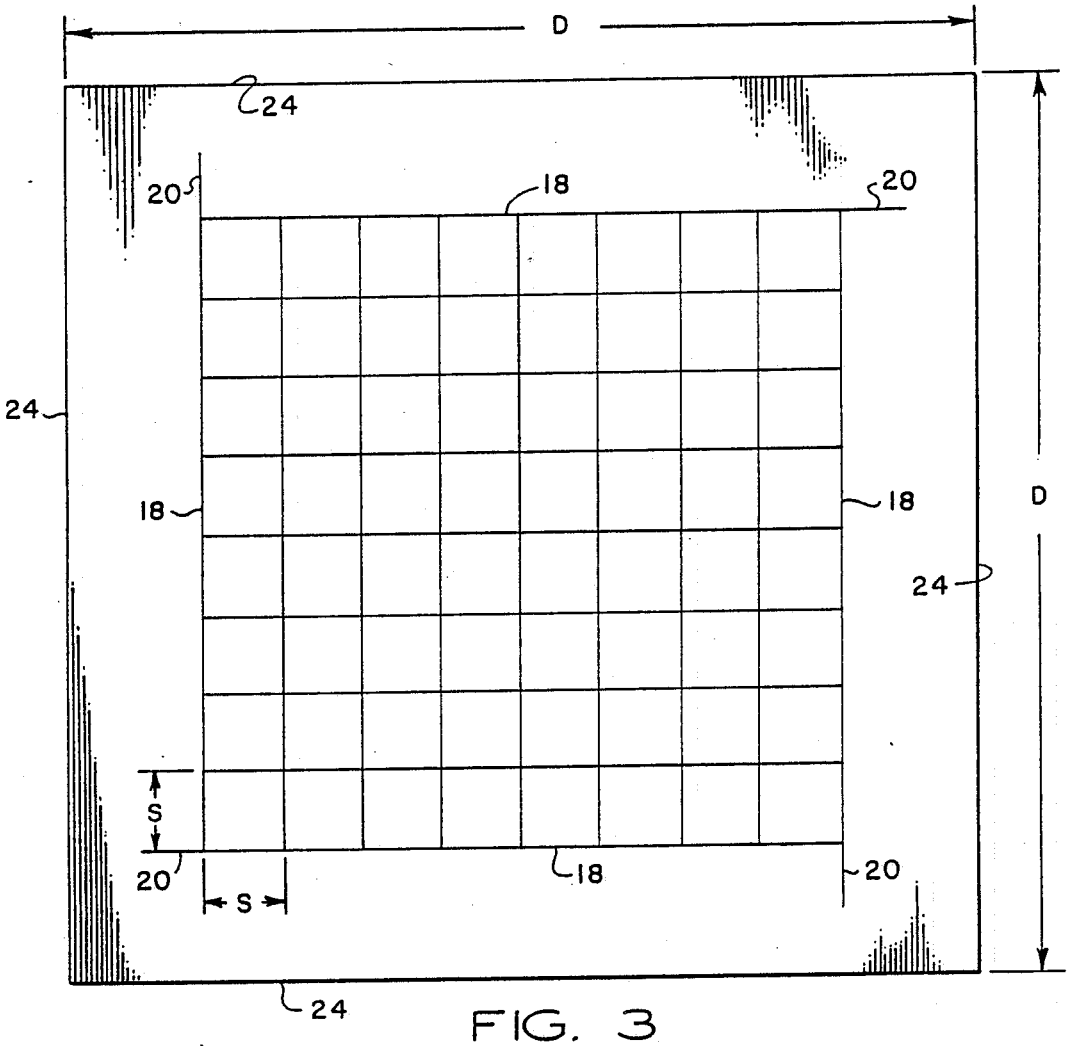
FIG. 3 is a front elevation view of a grid member used in the assembly of the decorative article in accordance with the present invention.

Referring to FIGS. 2A, 2D and 3, a rectangular grid pattern is imprinted on a wood substrate 14 and on a disposable paper sheet 16, as depicted in FIGS. 2A and 2D, respectively. The grid pattern has four boundary lines 18 interconnected to define a substantially rectangular grid boundary. A portion of each boundary line 18 extends beyond an adjacent boundary line 18 to define an extension segment 20 at one end thereof to facilitate the placement of wood frame 12, as will be described in greater detail hereinafter. The grid pattern is made up of a plurality of substantial identical squares. As best seen in FIG. 3, each side of a grid square has a length S and each side of wood substrate 14 has a length D. In the preferred embodiment length S is approximately 1.04 inches and length D is approximately 11.875 inches.

Figure 4A:
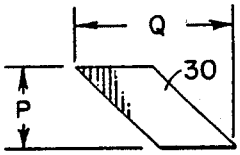
FIGS. 4A–4D are respective elevational views of the wood components used in the assembly of the decorative article in accordance with the present invention.
Figure 4B:
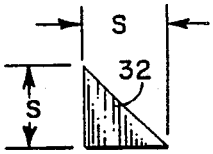
Figure 4C:
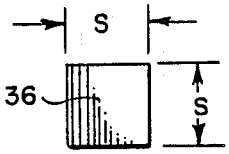
Figure 4D:
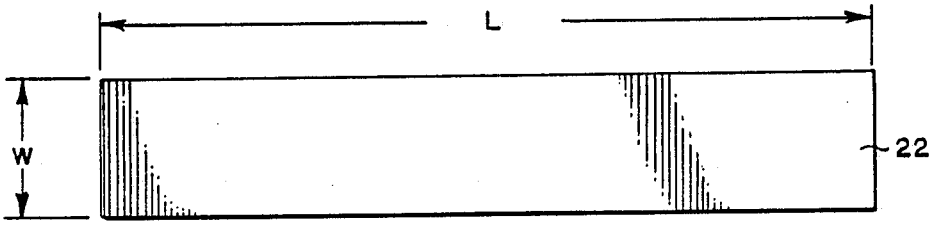

Referring to FIGS. 2B and 4D, wood frame 12 is comprised of four elongated wood members 22 of substantially identical size. As best seen in FIG. 4D, each frame member 22 has a length L along its major axis and a width W along its minor axis. In the preferred embodiment length L is approximately 10.12 inches and width W is approximately 1.80 inches. The thickness of each frame member 22 is preferably 0.110 inch. Referring also to FIG. 3, each frame member 22 is positioned on substrate 14 during the assembly process such that an inner edge of each frame member 22 is substantially aligned with a corresponding boundary line 18 and an outer edge thereof is substantially aligned with a side edge 24 of substrate 14 along a major axis of frame member 22. A first end of each frame member 22 is substantially aligned with extension segment 20 of an adjacent boundary line 18 and a second end thereof, opposite from the first end, is substantially aligned with another side edge 24 of substrate 14. When correctly positioned on substrate 14, all four frame members 22 will be in abutting relationship with one another, as best seen in FIG. 1, in which lines 26 represent the respective first ends of frame members 22 which are in alignment with the corresponding extension segments 20 of boundary lines 18.

Referring to FIGS. 2C and 4A–4C, the three wood pieces used to effect the predetermined design or pattern are depicted. The three wood pieces are comprised of a parallelogram piece 30, a triangle piece 32, and a square piece 36. Square 36 is precisely cut so that the length S of each of its sides is the same as the length of each side S of the individual squares comprising the grid pattern on substrate 14 and disposable sheet 16. In the preferred embodiment length S is approximately 1.04 inches. Triangle 32 is an isosceles right triangle, the length of each equal leg thereof being substantially equal to S. In the preferred embodiment the length of each equal leg of triangle 32 is approximately 1.04 inches. The acute angle between adjacent short and long sides of parallelogram 30 is approximately 45 degrees. The perpendicular distance P between the parallel short sides of parallelogram 30 is substantially equal to S (i.e., 1.04 inches in the preferred embodiment) and the perpendicular distance Q between parallel lines passing through opposite corners of parallelogram 30 at which the acute angles are located is $\sqrt{2}\times S$ (i.e., approximately 2.08 inches in the preferred embodiment). From the relationships, one can deduce that the length of each of the short sides is S and the length of each of the long sides is the same as the length of the hypotenuse of triangle 36 (i.e., $\sqrt{2}\times S$). The thickness of each piece 30, 32 and 36 is preferably on the order of 0.110 inch. By virtue of the size relationships among the three wood pieces 30, 32 and 36, designs and patterns of various types can be achieved by properly mixing and matching the individual wood pieces.

A method of making article 10 in accordance with the present invention is depicted in FIGS. 5–8. The first step in the process is to plan the desired pattern by assembling the individual wood pieces 30, 32 and 36 on disposable sheet 16 as shown in FIG. 5A. The grid pattern on disposable sheet 16 is used to facilitate assembly of the pattern. After the wood pieces have been assembled to achieve the desired pattern, the user should then paint the individual pieces 30, 32 and 36 to achieve the desired colors. Frame members 22 are also painted and all the painted pieces are allowed to dry for 12–24 hours.

Figure 5A:
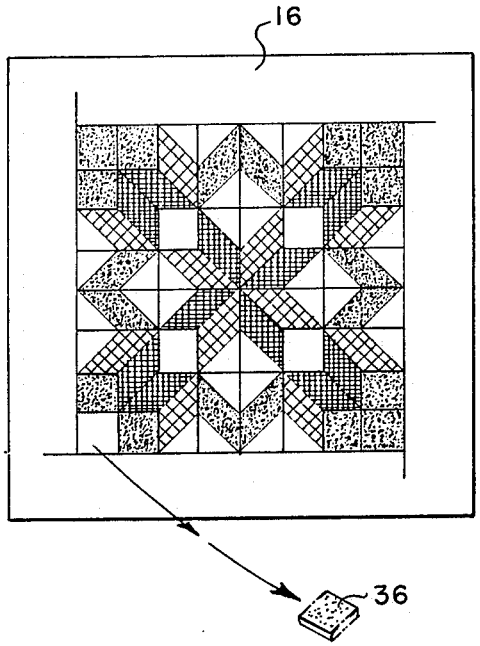
FIGS. 5–8 are respective top plan views illustrating the assembly of the decorative article in accordance with the present invention.
Figure 5B:
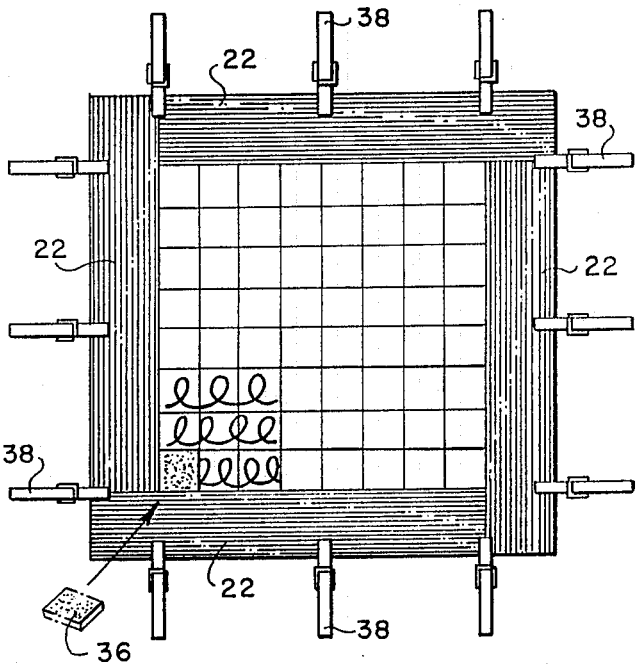
Figure 6A:
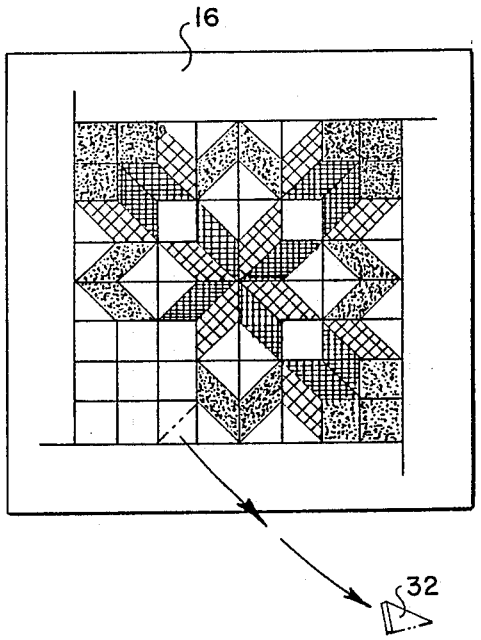
Figure 6B:
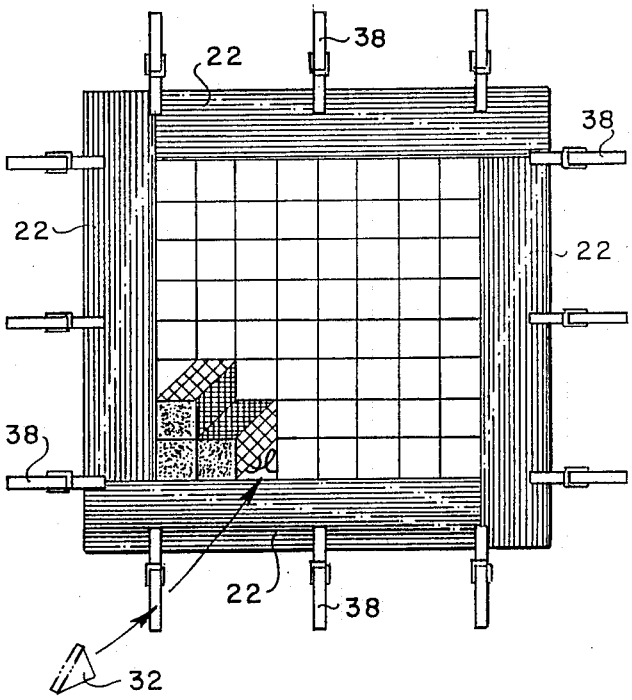

After the pieces have dried, they are assembled in the desired pattern on disposable sheet 16. Frame members 22 are positioned on the border surfaces of substrate 14 to circumscribe the grid pattern thereon and held in position by spring-loaded clothes pins 38 or the like, as shown in FIG. 5B. As described above, an inner edge of each frame member 22 is substantially aligned with a corresponding border line 18 and an outer edge thereof is substantially aligned with a side edge 24 of substrate 14 along a major axis of the corresponding frame member 22. A first end of each frame member 22 is substantially aligned with extension portion 20 of an adjacent boundary line 18 and a second end thereof, opposite from the first end, is substantially aligned with another side edge 24 of substrate 14. Wood glue is then applied to approximately 6–12 squares on the grid pattern of substrate 14 and the corresponding pieces 30, 32 and 36 are transferred from sheet 16 to substrate 14 and placed on the appropriate grid squares of substrate 14, as shown in FIGS. 5 and 6. It is important not to put too much glue on substrate 14 or the glue will ooze onto the upper surfaces of wood pieces 30, 32 and 36. It is also important not to apply glue to more than 12 grid squares at a time so that the glue does not dry out before the proper wood piece can be placed thereon.

Figure 7A:
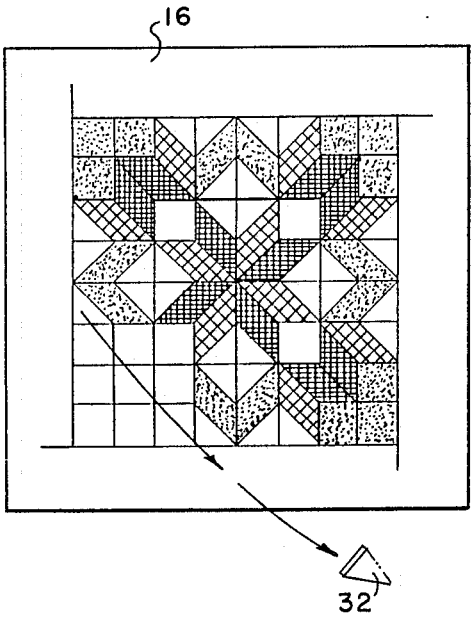
Figure 7B:
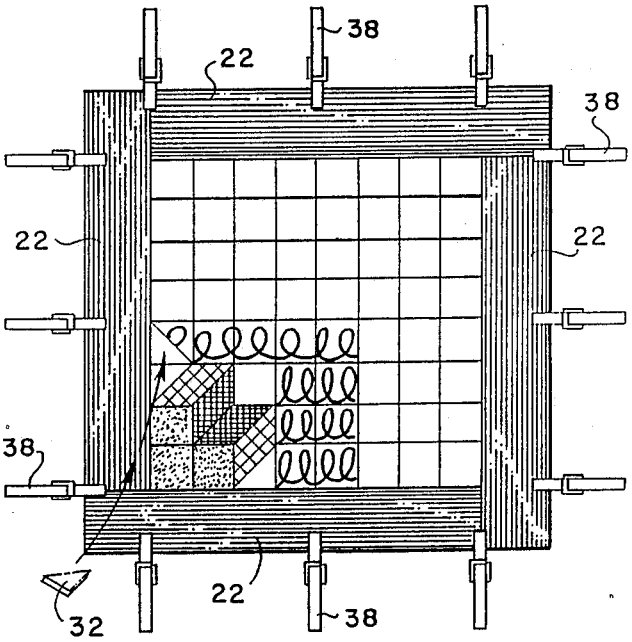
Figure 8A:
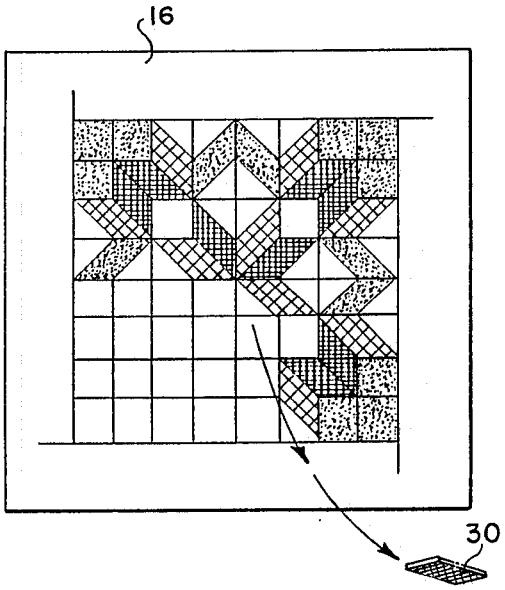
Figure 8B:
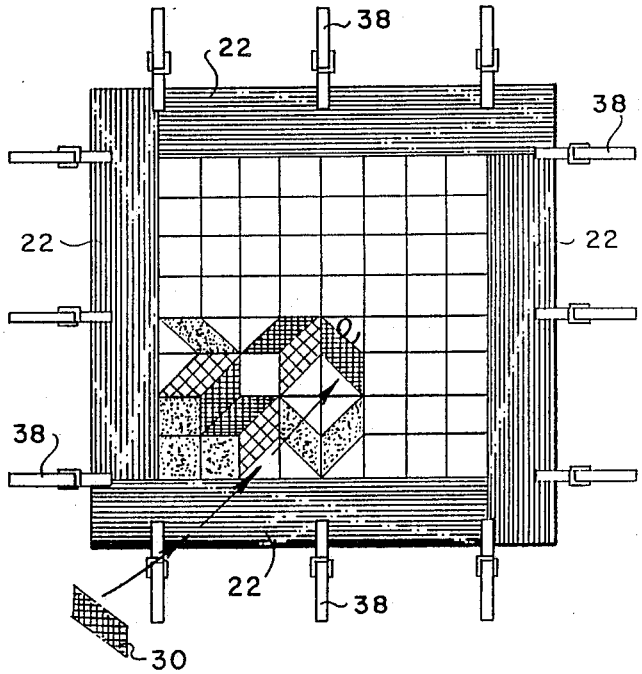

The aforementioned process is continued as shown in FIGS. 7 and 8 until all of the interior grid square are filled. Frame members 22 are then removed from substrate 14 and wood glue is applied to the border surfaces thereof. Frame members 22 are then reapplied to the respective border surfaces of substrate 14, as described above, and pressed snugly into contact with the wood glue on the border surfaces to securely attach frame members 22 thereto. The respective top surfaces of frame members 22 should be moistened to prevent the wood material from warping while the wood glue is drying. Any excess glue should be wiped off the respective upper surfaces of wood pieces 30, 32 and 36 and frame members 22 and the individual wood pieces may be adjusted while the glue is drying to achieve a good square fit. Clothes pins 38 are used to hold frame members 22 in place while the glue is drying.

After approximately 30 minutes, clothes pins 38 should be removed and the respective top surfaces of frame members 22 should be re-wiped with a wet rag. The assembled article should then be placed on a firm, flat surface and covered with a clean, flat board or similar object, such as a large cutting board, cookie sheet or tray. A weight of approximately 15–20 pounds should be applied on top of the cover for approximately 12–24 hours to allow article 10 to dry out completely.

After article 10 is completely dry, a hanger device may be attached to a back surface of substrate 14 so that article 10 can be hung as desired. A lint-free cloth or dusting brush should be used to remove dust and other minute particles from the decorative front surface of article 10. It is also recommended that lemon oil or the like be sprayed periodically on the article to keep the colors bright and reduce the likelihood of shrinkage.

Most of the components described above are preferably assembled in a kit with a detailed set of instructions to make it easy on the user. No tools are required and the only components which are not included in the kit are the wood glue, clothes pins, paint and paint brush.

Various embodiments of the invention have now been described in detail. Since it is obvious that many changes in and additions to the above-described preferred embodiment may be made without departing from the nature, spirit and scope of the invention, the invention is not to be limited to said details except as set forth in the appended claims.

What is claimed is:

1. A method of constructing a decorative article comprising the steps of:

providing a substrate having a grid pattern on a major surface thereof, a plurality of construction members for being assembled to effect a predetermined decorative design on said substrate and a plurality of frame members for being interconnected to define a frame around the decorative pattern;

positioning said frame members on said substrate such that said frame members surround said grid pattern to define a rectangular frame therefor and holding the frame members in position on the substrate;

applying adhesive material to a portion of said grid pattern;

placing selected ones of the construction members at respective selected positions on said portion of said grid pattern and allowing the adhesive material to bond said selected ones of said construction members to the substrate;

iteratively repeating the aforementioned two steps until the predetermined decorative design is effected;

removing the frame members from the substrate after the predetermined decorative design has been effected and applying adhesive material to portions of the substrate surrounding the decorative design; and repositioning the frame members on the portions of the substrate surrounding the decorative design and allowing the adhesive material to bond the frame members to the substrate to define a substantially permanent frame for the decorative design.

2. The method according to claim 1 wherein said construction members are comprised of first, second and third discrete sets of construction members, which are sized relative to one another such that they can be assembled to effect a variety of decorative designs.

3. The method according to claim 2 wherein said first, second and third sets of construction members are respectively comprised of a first plurality of parallelogram-shaped members, a second plurality of isosceles right triangle-shaped members and a third plurality of square-shaped members, each square-shaped member having a predetermined length S along each of its sides, each triangle-shaped member having a length substantially equal to S along each of its equal legs and each parallelogram-shaped member having a length substantially equal to S along each of its short sides and a length substantially equal to $\sqrt{2}\times S$ along each of its long sides, the grid pattern being comprised of a plurality of squares, each square having a length substantially equal to S along each of its sides.

4. The method according to claim 3 wherein S is approximately 1.04 inches.

5. The method according to claim 3 wherein each of the frame members is comprised of a relatively flat, rectangular member sized to conform to the portions of the substrate surrounding the grid pattern.

6. The method according to claim 5 wherein said substrate has four boundary lines interconnected to define a substantially rectangular boundary for said grid pattern, a portion of each boundary line extending beyond an adjacent boundary line to define an extension segment on the corresponding boundary line.

7. The method according to claim 6 wherein the steps of positioning and repositioning the frame members each include the sub-step of placing said frame members on said substrate such that an inner edge of each frame member is substantially aligned with a corresponding one of said boundary lines and first and second opposite ends of each frame member are substantially aligned with a corresponding extension segment and a corresponding outer edge of said substrate, respectively, the first end of each frame member being substantially in abutment with an inner edge of an adjacent frame member to define the rectangular frame.

8. The method according to claim 1 wherein said substrate, construction members and frame members are comprised of wood material.

9. The method according to claim 1 further including the steps of providing a sheet member having a grid pattern on a major surface thereof which is substantially identical to the grid pattern on said substrate and temporarily placing selected ones of the construction members at respective selected positions on the grid pattern of the sheet to effect the decorative design, prior to assembling the construction members on the substrate.

10. A decorative article, comprising:

a substrate having a grid pattern on a major surface thereof; and a plurality of construction members and frame members assembled on said substrate to effect a predetermined decorative design by the following steps:

positioning said frame members on said substrate such that said frame members surround said grid pattern to define a rectangular frame therefor and holding said frame members in position on the substrate;

applying adhesive material to a portion of the grid pattern;

placing selected ones of the construction members at respective selected positions on said portion of said grid pattern and allowing said adhesive material to bond said selected ones of said construction members to the substrate;

iteratively repeating the aforementioned two steps until the predetermined decorative design is effected;

removing the frame members from the substrate after the predetermined design is effected and applying adhesive material to portions of the substrate surrounding the decorative design; and repositioning the frame members on the portions of the substrate surrounding the decorative design and allowing the adhesive material to bond the frame members to the substrate to define a substantially permanent frame for the decorative design.

11. The article according to claim 10 wherein said construction members are comprised of first, second and third discrete sets of construction members, which are sized relative to one another such that they can be assembled to effect a variety of decorative designs.

12. The article according to claim 11 wherein said first, second and third sets of construction members are respectively comprised of a first plurality of parallelogram-shaped members, a second plurality of isosceles right triangle-shaped members and a third plurality of square-shaped members, each square-shaped member having a predetermined length S along each of its sides, each triangle-shaped member having a length substantially equal to S along each of its equal legs and each parallelogram-shaped member having a length substantially equal to S along each of its short sides and a length substantially equal to $\sqrt{2}\times S$ along each of its long sides, the grid pattern being comprised of a plurality of squares, each of which has a length substantially equal to S along each of its sides.

13. The article according to claim 12 wherein S is approximately 1.04 inches.

14. The article according to claim 12 wherein each of the frame members is comprised of a relatively flat, rectangular member sized to conform to the portions of the substrate surrounding the grid pattern.

15. The article according to claim 14 wherein the substrate has four boundary lines interconnected to define a substantially rectangular boundary for said grid pattern, a portion of each boundary line extending beyond an adjacent boundary line to define an extension segment on the corresponding boundary line.

16. The article according to claim 15 wherein said frame members are positioned on said substrate such that an inner edge of each frame member is substantially aligned with a corresponding one of said boundary lines and first and second opposite ends of each frame member are substantially aligned with a corresponding extension segment and a corresponding outer edge of said substrate, respectively, the first end of each frame member being substantially in abutment with an inner edge of an adjacent frame member to define the rectangular frame.

17. The article according to claim 10 wherein said substrate, construction members and frame members are all comprised of wood material.

18. The article according to claim 10 wherein said selected ones of said construction members are temporarily placed on a sheet member having a grid pattern on a major surface thereof which is substantially identical to the grid pattern on the substrate to effect the predetermined decorative design prior to assembling the construction members on the substrate.

19. A method of constructing a decorative article, comprising the steps of:

providing a wood substrate having a grid pattern on a major surface thereof, a plurality of wood construction members for being assembled to effect a predetermined decorative design on said substrate and a plurality of frame members for being interconnected to define a rectangular frame around the decorative pattern;

providing a sheet member having a grid pattern which is substantially identical to the grid pattern on said substrate and temporarily placing selected ones of said construction members at respective selected positions on the grid pattern of the sheet to effect the decorative design;

positioning the frame members on the substrate such that the frame members surround the grid pattern thereon to define the frame therefor and holding the frame members in position on the substrate;

applying adhesive material to a portion of the grid pattern on the subatrate;

moving the construction members from the sheet member to respective selected positions on said portion of said grid pattern on which the adhesive material has been applied and allowing the adhesive material to bond said construction members to the substrate;

iteratively repeating the aiorementioned two steps until the predetermined decorative design is effected on the substrate;

removing the frame members from the substrate after the decorative design has been effected thereon and applying adhesive material to portions of the substrate surrounding the decorative design; and repositioning the frame members on the portions of the substrate surrounding the decorative design and allowing the adhesive material to bond the frame members to the substrate to define a substantially permanent frame for the decorative design.

20. The method according to claim 19 wherein the step of providing the substrate, construction members and frame members includes the sub-step of providing first, second and third discrete sets of construction members, which are sized relative to one another such that they can be assembled to effect a variety of decorative designs, said first set of construction members being comprised of a first plurality of parallelogram-shaped members, said second set of construction members being comprised of a second plurality of isosceles right triangle-shaped members and said third set of construction members being comprised of a third plurality of square-shaped members, each square-shaped member having a predetermined length S along each of its sides, each triangle-shaped member having a length substantially equal to S along each of its equal legs and each parallelogram-shaped member having a length substantially equal to S along each of its short sides and a length substantially equal to $\sqrt{2} \times S$ along each of its long sides, the respective grid patterns on the sheet member and the substrate each being comprised of a plurality of squares, each square having a length substantially equal to S along each of its sides.

* * * * *